United States Patent [19]

Gontowski, Jr.

[11] Patent Number: 4,885,525

[45] Date of Patent: Dec. 5, 1989

[54] VOLTAGE CONTROLLABLE CURRENT SOURCE

[75] Inventor: Walter S. Gontowski, Jr., Thompson, Conn.

[73] Assignee: Cherry Semiconductor Corporation, East Greenwich, R.I.

[21] Appl. No.: 343,844

[22] Filed: Apr. 26, 1989

[51] Int. Cl.[4] ..... G05F 3/16

[52] U.S. Cl. ..... 323/315; 323/312

[58] Field of Search ..... 323/312, 315

[56] References Cited

U.S. PATENT DOCUMENTS

| | | | |
|---|---|---|---|
| 4,268,789 | 5/1981 | Nagano | 323/315 |
| 4,716,356 | 12/1987 | Vyne et al. | 323/312 |
| 4,808,907 | 2/1989 | Main | 323/312 |

*Primary Examiner*—Patrick R. Salce

*Assistant Examiner*—Jeffrey Sterrett

*Attorney, Agent, or Firm*—Robert M. Asher; Henry D. Pahl

[57] ABSTRACT

In the voltage controlled current source disclosed herein, temperature compensation is provided by offsetting base emitter voltage drops in a pair of bipolar transistors of complementary conductivity types. The control voltage is applied through a resistor to the emitter of a first transistor connected in common base mode. The base voltage of the first transistor is obtained from the emitter of a transistor of complementary conductivity type, the base of which is connected to a stable voltage source. The collector current of the first transistor is then applied to a current mirror to obtain an output current which is highly proportional to the control voltage.

8 Claims, 1 Drawing Sheet

VOLTAGE CONTROLLABLE CURRENT SOURCE

The present invention relates to a voltage controllable current source and more particularly to such a source which is relatively insensitive to temperature induced variations.

In various types of control circuits, particularly those utilizing analog timing, it is often desirable to incorporate a current source which will source (or sink) a current having a value which is proportional to a control voltage. The controlled current is typically utilized to charge or discharge a timing capacitor, e.g. as may be employed in a voltage controlled oscillator or one-shot multivibrator. As will be understood by those skilled in the art, linearity and temperature insensitivity are desirable attributes for such a current source. In prior art systems, however, high degrees of linearity and temperature insensitivity were achieved only through relatively complex arrangements, e.g. arrangements which employed a separate operational amplifier for monitoring the value of the sourced current. Such complexity is not warranted in many applications, particularly those in which a complete control system is to be implemented in an integrated circuit.

Among the several objects of the present invention may be noted the provision of a voltage controllable current source which is relatively insensitive to temperature variation; the provision of such a current source which provides a high degree of linearity or proportionality between the output current and the control voltage which is to determine the output current; the provision of such a current source which is operable over a wide range; the provision of such a current source which employs relatively few circuit elements; the provision of such a current source which may be readily easily implemented in an integrated circuit; the provision of such a current source which is highly reliable and which is of relatively simple and inexpensive construction. Other objects and features will be in part apparent and in part pointed out hereinafter.

SUMMARY OF THE INVENTION

Briefly, the current source of the present invention employs a pair of transistors of complementary conductivity types controlling input to a current mirror. A stable voltage is applied to the base of one transistor thereby to provide at its emitter an intermediate voltage which differs from the stable voltage by one base emitter drop. The base of the complementary conductivity type transistor is connected to the emitter of the first transistor thereby to establish at the emitter of the complementary conductivity type transistor an input voltage which is essentially equal to the stable voltage. A control voltage is applied, through a resistor, to the emitter of the complementary conductivity type transistor. Accordingly, the current applied to that emitter is proportional to the difference of the stable voltage and the control voltage. The collector of the complementary conductivity type transistor is connected to the input of the current mirror and thus the output of the current mirror will be an essentially linear function of the control voltage.

BRIEF DESCRIPTION OF THE DRAWINGS

Corresponding reference characters indicate corresponding parts throughout the several views of the drawings.

PRIOR ART

Figure 1:
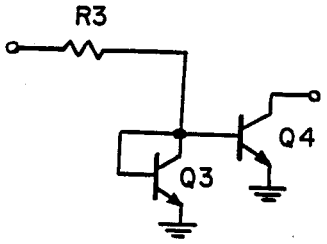
FIG.1 PRIOR ART
FIG. 1 is a schematic circuit diagram of one prior art type of voltage controllable current source.

FIG. 1 illustrates a relatively simple method of utilizing a voltage to control a current source. This basic type of circuit is sometimes referred to as a current mirror. The FIG. 1 circuit utilizes the characteristic of bipolar transistors that the base-emitter voltage is directly related to the amount of current flowing in the collector. A first NPN transistor Q3 is connected as a diode as shown, i.e. the collector is connected to the base. The control voltage is applied to this diode through a resistor R3. A second NPN transistor Q4 is connected with its base-emitter junction in parallel with Q3. Accordingly, the collector of Q4 will sink a current which is proportional to that which flows in Q3 and which constitutes the output of the circuit. One problem with this type of circuit is due to the errors introduced by the required base currents of Q3 and Q4. Additionally, the input current applied through resistor R3 is not strictly proportional to the control voltage since the voltage across resistor R1 is reduced by the base-emitter voltage drop. As is understood, this drop varies from device to device and with temperature.

Figure 2:
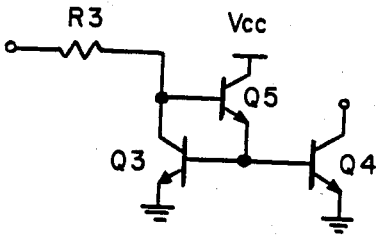
FIG.2 PRIOR ART
FIG. 2 is a schematic circuit diagram of a second prior art type of voltage controllable current source.

The effects of the base current errors may be reduced by the addition of a buffer transistor Q5 as shown in FIG. 2. The base currents are in effect reduced by a factor equal to the beta of the added transistor. However, the additional base-emitter voltage drop introduced by transistor Q5 produces an added error in the proportionality of the input current to control voltage. This additional error may more than offset the improvement obtained, particularly when the control voltage is relatively small, i.e. in relation to the base-emitter drops.

DESCRIPTION OF THE PREFERRED EMBODIMENTS

Figure 3:
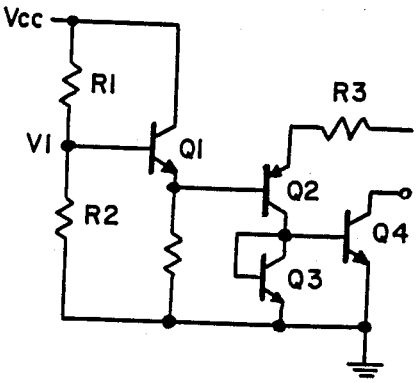
FIG. 3 is a schematic circuit diagram of a voltage controllable current source constructed in accordance with the present invention.

Referring now to FIG. 3, it can be seen that this embodiment utilizes an output stage which employs a current mirror similar to that utilized in the circuit of FIG. 1, i.e. transistors Q3 and Q4 are interconnected as a current mirror with the transistor Q3 being connected as a diode as in FIG. 1. Rather than directly applying the control voltage or current to the current mirror, however, the arrangement of FIG. 3 employs two bipolar transistors which are of complementary conductivity type, these being transistor Q1 which is of the NPN conductivity type and the transistor Q2 which is of the PNP conductivity type.

A voltage divider comprising a pair of resistors R1 and R2 is connected across a pair of regulated supply leads (VCC and ground) to provide a stable voltage, designated V1, to the base of the NPN transistor Q1. An emitter load resistor is provided as indicated at R4. The emitter of transistor Q1 thus provides an intermediate voltage which is essentially equal to the voltage V1 reduced by one base-emitter drop.

The PNP transistor Q2 is connected in a common base configuration with its base being connected to the emitter of NPN transistor Q1. The control voltage is applied to the emitter of transistor Q2 through resistor R3. The voltage at the emitter of transistor Q2 will be equal to the intermediate voltage plus a base-emitter drop and thus will also be essentially equal to the stable voltage V1. Since the input resistor R3 is connected to the emitter of transistor Q2, it can be seen that the current flow in resistor R3 will be quite closely proportional to the difference between V1 and the control voltage. Further, since the base-emitter voltage drops of transistors Q1 and Q2 will track reasonably well over temperature, particularly if they are constructed as part of the same integrated circuit, the proportionality between control voltage and input current will be relatively temperature sensitive.

The collector of transistor Q2 is connected to the input of the current mirror. Since the transistor Q2 is connected in a common base configuration as noted earlier, the input current to the current mirror will be essentially equal to the input current, less the small and essentially proportional base current required to drive transistor Q2. Since the current mirror maintains proportionality, it can be seen that a high degree of accuracy and linearity is maintained throughout in converting input voltage to output current.

Figure 4:
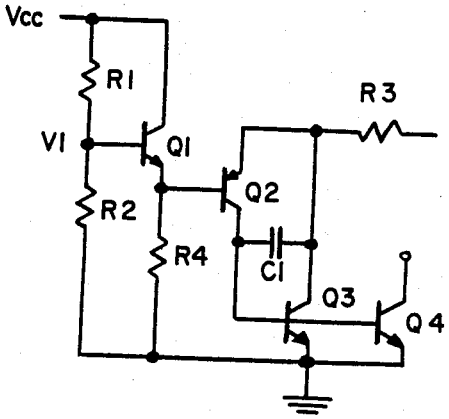
FIG. 4 is a schematic circuit diagram of a voltage controllable current source constructed in accordance with the present invention and providing improved linearity of response.

As PNP transistors in integrated circuits are typically fabricated using lateral diffusion techniques, their gains may not be as great as that of NPN transistors. Thus, the portion of the current flowing through R3 which goes out through the base terminal of transistor Q2 (rather than out into the current mirror) may be significant in some critical applications. The embodiment of FIG. 4 provides a further improvement by reducing this source of error. This improvement, however, does not require any additional active elements. In the embodiment of FIG. 4, the collector of NPN transistor Q3 is connected to the emitter of the PNP transistor Q2 rather than to its own base. Accordingly, the gain of transistor Q3 is effectively added to that of transistor Q2 in reducing the proportion of the current flowing through resistor R3 which is required for base current to PNP transistor Q2 and thereby reduces variation in the input voltage with input current. In view of the high loop gain, a capacitor C1 may be required between the collectors of transistors Q2 and Q3, as illustrated, in order to insure stability.

With this connection, Q2 only conducts an amount of current necessary to supply base current for Q3 and Q4. With Q2 conducting only a small amount of current, the alpha losses are relatively insignificant. If the error due to the effect of base current is objectionable, then a buffer transducer can be added in similar fashion to the one (Q5) utilized in FIG. 3.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A current source proportionally responsive to a control voltage comprising:

a first bipolar transistor of a first conductivity type;

means for providing a stable voltage to the base of said transistor thereby to provide at the emitter of said transistor an intermediate voltage which differs from said stable voltage by one base-emitter drop;

a second bipolar transistor of conductivity type complementary to said first conductivity type, the base of said second transistor being connected to the emitter of said first transistor thereby to establish at the emitter of said second transistor an input voltage which is essentially equal to said stable voltage, the emitter of said second transistor being connected to said control voltage through a resistor whereby the current applied to that emitter is proportional to the difference between said stable voltage and said control voltage;

a current mirror, the collector of said second transistor being connected to the input of said current mirror, whereby the output current of said current mirror is essentially a linear function of said control voltage.

2. A current source as set forth in claim 1 wherein said first transistor is of the NPN conductivity type and said second transistor is of the PNP conductivity type.

3. A current source as set forth in claim 2 wherein said current mirror comprises third and fourth bipolar transistors, said third and fourth transistors being of NPN conductivity type with their bases connected in common to the collector of said second transistor.

4. A current source as set forth in claim 3 wherein the collector of said third transistor is connected to its base in diode fashion.

5. A current source as set forth in claim 3 wherein the collector of said third transistor is connected to the emitter of said second transistor thereby to increase the loop gain maintaining said input voltage constant.

6. A current source proportionally responsive to a control voltage comprising:

a first bipolar transistor of a first conductivity type;

means for providing a stable voltage to the base of said transistor thereby to provide at the emitter of said transistor an intermediate voltage which differs from said stable voltage by one base-emitter drop;

a second bipolar transistor of conductivity type complementary to said first conductivity type, the base of said second transistor being connected to the emitter of said first transistor thereby to establish at the emitter of said second transistor an input voltage which is essentially equal to said stable voltage, the emitter of said second transistor being connected to said control voltage through a resistor whereby the current applied to that emitter is proportional to the difference between said stable voltage and said control voltage; and third and fourth bipolar transistors, said third and fourth transistors being of said first conductivity type and being interconnected as a current mirror with their bases connected in common to the collector of said second transistor, the collector of said third transistor being connected to its base in diode fashion, the collector of said fourth transistor constituting the output of said current source.

7. A current source proportionally responsive to a control voltage comprising:

a first bipolar transistor of a first conductivity type;

means for providing a stable voltage to the base of said transistor thereby to provide at the emitter of said transistor an intermediate voltage which differs from said stable voltage by one base-emitter drop;

a second bipolar transistor of conductivity type complementary to said first conductivity type, the base of said second transistor being connected to the emitter of said first transistor thereby to establish at the emitter of said second transistor an input voltage which is essentially equal to said stable voltage, the emitter of said second transistor being connected to said control voltage through a resistorwwhereby the current applied to that emitter is proportional to the difference between said stable voltage and said control voltage; and third and fourth bipolar transistors, the bases of said third and fourth transistors being connected to the collector of said second transistor, the collector of said third transistor being connected to the emitter of said second transistor thereby to augment the gain of said second transistor in reducing variation in said input voltage with input current, the collector of said fourth transistor constituting the output of said current source.

8. A current source proportionally responsive to a control voltage comprising:

a first bipolar transistor of the NPN conductivity type;

means for providing a stable voltage to the base of said transistor thereby to provide at the emitter of said transistor an intermediate voltage which differs from said stable voltage by one base-emitter drop;

a second bipolar transistor which is of the PNP conductivity type, the base of said second transistor being connected to the emitter of said first transistor thereby to establish at the emitter of said second transistor an input voltage which is essentially equal to said stable voltage, the emitter of said second transistor being connected to said control voltage through a resistor whereby the current applied to that emitter is proportional to the difference between said stable voltage and said control voltage; and third and fourth bipolar transistors which are of the NPN conductivity type, the bases of said third and fourth transistors being connected to the collector of said second transistor, the collector of said third transistor being connected to the emitter of said second transistor thereby to augment the gain of said second transistor in reducing variation in said input voltage with input current, the collector of said fourth transistor constituting the output of said current

* * * * *

UNITED STATES PATENT AND TRADEMARK OFFICE

CERTIFICATE OF CORRECTION

PATENT NO. : 4,885,525

DATED : December 5, 1989

INVENTOR(S) : Walter S. Gontowski, Jr.

It is certified that error appears in the above-identified patent and that said Letters Patent is hereby corrected as shown below:

At column 5, line 11, please delete "resistorw-" and insert --resistor--.

At column 6, line 26, after the word "current", please insert --source.--.

Signed and Sealed this

Fifth Day of March, 1991

*Attest:*

HARRY F. MANBECK, JR.

*Attesting Officer*

*Commissioner of Patents and Trademarks*